US011355886B2

(12) United States Patent
Kliever

(10) Patent No.: US 11,355,886 B2
(45) Date of Patent: Jun. 7, 2022

(54) CONTACT CARRIER HAVING STABLE DETENT DEVICE

(71) Applicant: HARTING Electric GmbH & Co. KG, Espelkamp (DE)

(72) Inventor: Wilhelm Kliever, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 17/274,205

(22) PCT Filed: Aug. 9, 2019

(86) PCT No.: PCT/DE2019/100724
§ 371 (c)(1),
(2) Date: Mar. 8, 2021

(87) PCT Pub. No.: WO2020/069690
PCT Pub. Date: Apr. 9, 2020

(65) Prior Publication Data

US 2021/0336380 A1 Oct. 28, 2021

(30) Foreign Application Priority Data

Oct. 1, 2018 (DE) ..... 10 2018 124 197.6

(51) Int. Cl.
*H01R 13/58* (2006.01)
*H01R 13/422* (2006.01)
(Continued)

(52) U.S. Cl.
CPC ..... *H01R 13/5808* (2013.01); *H01R 13/426* (2013.01); *H01R 13/4226* (2013.01);
(Continued)

(58) Field of Classification Search
CPC ..... H01R 13/4367; H01R 13/4368
See application file for complete search history.

(56) References Cited

U.S. PATENT DOCUMENTS 3,697,928 A 10/1972 Hammell
3,812,447 A 5/1974 Eifler et al.
(Continued)

FOREIGN PATENT DOCUMENTS

DE 1515813 B2 10/1970
DE 19631467 A1 2/1998
EP 3232517 B1 1/2019

*Primary Examiner* — Ross N Gushi
(74) *Attorney, Agent, or Firm* — Smartpat PLC

(57) ABSTRACT

A contact carrier retains a crimp contact inserted therein at a central collar of the crimp contact in a particularly stable manner and at the same time absorb the highest possible plugging forces. The contact carrier has an insulating body and a retaining plate, which can be mounted thereon on the connection side. Furthermore, the contact carrier has at least one detent element, which, in the unassembled state, can assumed both a position locking the plug contact and a position releasing the plug contact. The detent element is part of the insulating body. The retaining plate also has at least one blocking element, which, in the assembled state, fixes the detent element in the position thereof locking the plug contact and thus prevents the transition of the detent element from the locking position into the releasing position.

9 Claims, 4 Drawing Sheets

(51) Int. Cl.
*H01R 13/426* (2006.01)
*H01R 13/436* (2006.01)
*H01R 13/627* (2006.01)

(52) U.S. Cl.
CPC ..... *H01R 13/4365* (2013.01); *H01R 13/6273* (2013.01); *H01R 13/4368* (2013.01)

(56) References Cited

U.S. PATENT DOCUMENTS 9,960,515 B2 * 5/2018 Uenosono ..... H01R 13/4223
2017/0294742 A1 10/2017 Villeroche et al.

* cited by examiner

CONTACT CARRIER HAVING STABLE DETENT DEVICE

TECHNICAL FIELD

The disclosure relates to a contact carrier suitable for receiving and fastening a plug contact and to a method for mounting a plug contact in a contact carrier. Such contact carriers are required to hold at least one plug contact installed therein and, with this, to absorb the mating forces acting thereon during the mating procedure. The plug contact can feature a cable connection region on the connection side, namely a crimp connection, and a mating region on the mating side, for example a contact pin or a contact socket. The plug contact can have a central collar between the mating region and the cable connection region. In addition, the plug contact can feature a connection-side collar on its connection-side end.

BACKGROUND

Single- and multi-part contact carriers for receiving and for holding plug contacts are generally known in the prior art.

To fix the above-mentioned plug contacts in place, latching methods are known, in which a contact carrier provided therefor holds such a plug contact at its connection-side collar against mating forces which arise. In this design, the central collar of the plug contact has a connection-side chamfer, i.e. facing in the direction of the cable connection, to enable or facilitate the removal of the plug contact from this contact carrier.

In this case, the central collar has, amongst other things, the function of ensuring the guidance of the plug contact within the contact carrier, together with the connection-side collar, and, with this, of centering the mating region of said plug contact in a hollow-cylindrical through-opening of the contact carrier. Furthermore, the central collar also has a mating-side holding face, i.e. facing in the direction of the mating region. This holding face can cooperate with the contact carrier to prevent the plug contact from penetrating too deeply into the contact carrier in the direction of the mating side thereof.

In this design, the plug contact received in the corresponding contact carrier can therefore be secured against a movement in the direction of the mating side by means of its central collar and against a movement in the direction of the cable connection side by means of its connection-side collar.

However, this arrangement has been shown to be disadvantageous in practice for the following reasons: the crimp connection of the plug contact essentially experiences elongation during crimping. This elongation varies depending on the type of crimping procedure, i.e. depending on the type of crimping tongs, crimping machine or other crimping tools, for example Therefore, the change in length of the crimp connection cannot yet be quantified precisely during the manufacture of the plug contact and/or the contact carrier.

If the elongation experienced by the crimp connection during crimping is somewhat shorter than expected, the plug contact then has corresponding play in the above-mentioned contact carrier in the mating direction. If the elongation is greater than expected, this can lead to difficulties when assembling the plug contacts on the contact carrier, namely if the crimped crimp connection no longer fits into the portion of the contact carrier which is provided to receive it.

Therefore, attempts have already been made to establish a uniform crimping process for such plug connectors, but this has not been met with a unanimous response on the part of the customer. Contact carriers which hold the plug contact at its connection-side collar should therefore be regarded as disadvantageous.

To solve this problem, latching mechanisms have furthermore become known, which engage with the plug contacts between their cable connection region (crimp connection) and their mating region (contact pin/contact socket) on both sides such that they act both in and contrary to the mating direction.

For example, a device for holding replaceable contact elements in electrical plug connectors is known from printed document DE 15 15 813 B2, in which, between the cable connection region and the mating region, an additional arresting means, for example a locking cone, secures the contact element in a single-part contact carrier and absorbs the mating forces.

This design is disadvantageous in that at least one additional arresting means, for example in the form of a snap ring, a locking clip, the locking cone or a latching hook, is needed to fix the electrical contacts in place.

DE 196 31 467 A1 features a multi-pole plug connection with a plurality of plug contacts which are each received in a through-opening of a multi-part contact carrier. In this case, an integrally formed latching portion projecting from one side of the through-opening engages in a holding recess in the central portion of the plug contact and supports the plug contact against an axial load. A flexible tongue lying opposite the integrally formed latching portion holds the plug contact in its mounted position.

Unfortunately, it has been shown in the prior art that many commercially available plug contacts (for example, Han C type plug contacts by HARTING) cannot be fixed in such contact carriers by such latching mechanisms with sufficient stability to withstand the mating forces which arise. Ultimately, the contact face, which, according to this fastening method, is relevant to the latching process, is chamfered on the connection side of its central collar, as already mentioned at the outset. However, this connection-side chamfer is disadvantageous in that, under a certain mating force, the contact chamfer of the central collar presses the known arresting means into its unlocking position, whereby undesired releasing takes place. Nevertheless, these plug contacts are commercially available in large numbers and should also continue to be used, in particular also due to their excellent long-term behavior which has been proven in practice.

The German Patent and Trademark Office has searched the following prior art in the priority application relating to the present application: EP 3 232 517 A1.

SUMMARY

An object of the disclosure is to provide a contact carrier, which, if necessary, is also capable of also holding a plug contact inserted therein in a particularly stable manner at its chamfered central collar arranged thereon and, with this, absorbing the highest mating forces possible.

This object is achieved by the features of the independent claims.

A contact carrier has a mating side and, on the opposite side, a connection side and serves to receive and fasten a plug contact which features a crimp connection and a central collar with a connection-side chamfer. The contact carrier has an insulating body and a holding plate which can be mounted thereon on the connection side. The contact carrier furthermore has at least one latching element, which, in the unmounted state, can assume both a position latching the plug contact in place and a position releasing the plug contact.

The latching element is a component of the insulating body. The holding plate furthermore has at least one locking element, which, in the mounted state, fixes the at least one latching element in its position latching the plug contact in place and therefore prevents its transfer from the latching position into the release position.

The term "connection-side" is used here and below to mean "cable-connection side", i.e. on the respective cable connection side and/or at least inclined or aligned in the direction of the respective cable connection side. The term "connection side" essentially represents the cable connection side.

The latching element can preferably be a latching arm.

This is particularly advantageous because, in this way, the plug contact latches as necessary on the insulating body instead of on the holding plate. By means of the locking element, the mounted holding plate in turn merely ensures the fixing of the at least one latching element of the insulating body in its position latching the plug contact in place. In this case, the holding plate itself does not absorb any mating forces. The contact carrier can thus absorb the forces arising during the mating procedure in a particularly effective manner since the holding plate is relieved of the mating forces which naturally act in the direction of the connection side—and therefore in its dismantling direction.

It is therefore possible to also hold the contact pin in the contact carrier in a particularly stable and reliable manner at its central collar if the central collar is chamfered on the connection side. Ultimately, the at least one latching element is fixed in its latching position by means of the locking element and, in the fixed state, cannot be moved into its release position in spite of the connection-side chamfer of the central collar, even under particularly strong mating forces.

Therefore, even those contact pins which could otherwise not be latched in the contact carrier with a sufficient holding force owing to the connection-side chamfer of their central collar can advantageously also be fixed centrally in the contact carrier.

Such a central fixing in place, i.e., a latching at the central collar which is locked against release, is furthermore particularly advantageous for the following reasons:

In this case, it is particularly advantageous to hold the plug contacts at their central collar to latch them in the insulating body because the imprecise elongation of the crimp connection is then unable to affect the positioning of the plug contact, in particular its contact pin, relative to the contact carrier.

By means of the inventive contact carrier, it is also possible to use the plug contacts whereof the central collar features a connection-side chamfer, i.e., the Han C type contacts by HARTING, for example. On the one hand, this is of great advantage because these plug contacts are already commercially available in large numbers.

Furthermore, they can be manufactured cost-effectively in this form by means of existing manufacturing processes and devices. Moreover, they are already proven in the present form in terms of many other quality criteria. Ultimately, from the point of view of the customer, it is essentially advantageous to have a manageable number of different types of plug contacts which are as universally usable as possible, than many different types which can only be used in very specific applications in each case. The inventive contact carrier therefore advantageously contributes to the compatibility of existing plug contacts for different latching methods and can be manufactured all the more cost-effectively in large quantities.

As a result of the inventive design of the contact carrier, this type of plug contact can ultimately be used universally. Specifically, these plug contacts do not need to be held in conventional contact carriers at their connection-side collar, but can advantageously now also be latched on the inventive contact carrier in a stable manner at their chamfered central collar.

Advantageous configurations of the invention are revealed in the dependent claims.

In a preferred configuration, the insulating body can have a square basic form with a preferably substantially cylindrical through-opening, which extends from the connection side to the mating side, i.e. its axis of symmetry possibly extends in the mating direction. The at least one latching element can be a latching arm in each case, which is integrally formed on the inner surface of the through-opening and projects into the through-opening for latching the plug contact in place, in particular by means of a latching lug formed thereon. The insulating body preferably has at least two such latching arms. At least three, in particular at least four, latching arms are particularly preferably integrally formed in the inner surface of the through-opening of the insulating body.

In particular, the insulating body therefore has at least two, in particular at least three, preferably at least four, i.e. two, three, four, five, . . . , n latching arms, for example, for latching the inserted plug contact in place at its central collar and therefore for preventing a movement of the plug contact in the direction of the connection side of the contact carrier. Furthermore, the contact carrier can have at least two, in particular at least three, preferably at least four, i.e. two, three, four, five, . . . , n holding elements, for example, which are integrally formed on the inner surface of the insulating body and which prevent a deeper movement of the plug contact in the direction of the mating side of the contact carrier. In this case, one of the said holding elements can advantageously always be arranged between two of the said latching arms in each case. In particular, the latching arms and the holding elements can be integrally formed together on a circumferential inner collar integrally formed in the through-opening. They therefore have particularly good stability and can absorb particularly high mating forces.

In a preferred configuration, the holding plate can have a square or at least rectangular base plate with a preferably circular insertion opening. The locking element can be a locking sleeve, which is integrally formed on the base plate and through which the said insertion opening extends. In a particularly preferred configuration, the locking sleeve has a hollow-cylindrical basic form. The outer radius of the locking sleeve can then be smaller than the inner radius of the through-opening of the insulating body so that the locking sleeve can be inserted into the through-opening of the insulating body during the mounting procedure and points in the direction of the mating side.

The locking sleeve, in the mounted state, can be arranged, in particular, with force fit between the at least one latching element, in particular the at least one latching arm, and an inner surface of a through-opening of the insulating body. The locking sleeve thus prevents an outward movement of the at least one latching element, i.e. towards the said inner surface of the through-opening, and thereby prevents the transfer of the latching element from the position latching the plug contact in place into the position releasing it.

In a further preferred configuration, the holding plate can itself be latched on the insulating body in two different positions, namely in an assembly position and a locking position. In the assembly position, the plug contact can be inserted into the contact carrier on the connection side and firstly latched on the latching element. The locking position corresponds to the mounted state in which the plug contact is finally held in the contact carrier in a stable manner. In this assembled state (locking position), the contact carrier can therefore absorb particularly high mating forces.

In a particularly preferred configuration, the holding plate can have two fastening plates for this purpose, which are arranged on two mutually opposite sides of the base plate, at a right-angle thereto. For the purpose of the above-mentioned multi-stage latching, two respective latching windows, namely a first latching window and a second latching window, can be arranged on each fastening plate. The insulating body can feature a respective outwardly open depression on two mutually opposite outer surfaces, which depressions adjoin the connection side, extend in the direction of the mating side and are delimited by two outer webs. To mount the contact carrier, one of the fastening plates of the holding plate can then be inserted into the respective depression in each case, in particular fitting precisely between the webs. In the region of the depression, two respective integrally formed latching portions, namely a first and a second integrally formed latching portion, arranged offset from one another in the mating direction and corresponding to the latching windows of the fastening plates, are arranged on the respective outer surface of the insulating body.

In a particularly preferred configuration, the mounting of the contact carrier with the plug contact can take place as follows:

During the insertion of the fastening plates of the holding plate into the depressions of the insulating body, the respective first integrally formed latching portion firstly latches in the second latching window of the respective fastening plate. In this state, the holding plate is located in its assembly position on the insulating body.

The plug contact, which is, for example, a pin or socket contact, can be crimped to an electrical stranded conductor of an electrical cable on the connection side. The plug contact, with its mating region at the front, can then be inserted through the insertion opening of the holding plate into the through-opening of the insulating body and latched in its final mounted position. Deeper insertion of the plug contact is prevented by its central collar striking against the at least one further inner integrally formed portion. For latching purposes, the latching arms of the insulating body thereby reach behind the chamfered central collar. In this state, the plug contact can still be removed from the contact carrier in the cable connection direction under the effect of a sufficiently high mating force from the mating-side direction (or tensile force from the connection-side direction).

The holding plate is now moved from its assembly position into its final locking position. The contact carrier is thus finally mounted and the plug contact is fixed in its final mounted position in the contact carrier with the desired high holding force. For this purpose, the locking sleeve is arranged between the latching arms and the inner surface of the through-opening. The locking sleeve thus prevents an outwardly directed movement of the of the latching arms, i.e. towards the inner surface of the through-opening. The latching arms are therefore locked against being transferred into their release position. The plug contact, in spite of the connection-side chamfer of its central collar, cannot press the latching arms apart, even under the effect of high mating forces. It is therefore held in the contact carrier in a particularly stable manner. The high mating forces are absorbed as necessary by the insulating body on which the latching arms are ultimately arranged. The holding plate is therefore not subjected to forces which unlock/dismantle it.

BRIEF DESCRIPTION OF THE DRAWINGS

An exemplary embodiment of the invention is illustrated in the drawings and will be explained in more detail below. In the drawings.

DETAILED DESCRIPTION

The figures contain partially simplified, schematic illustrations. Identical reference signs are sometimes used for elements which are similar, but possibly not identical. Different views of similar elements might be drawn to different scales.

Figure 1:
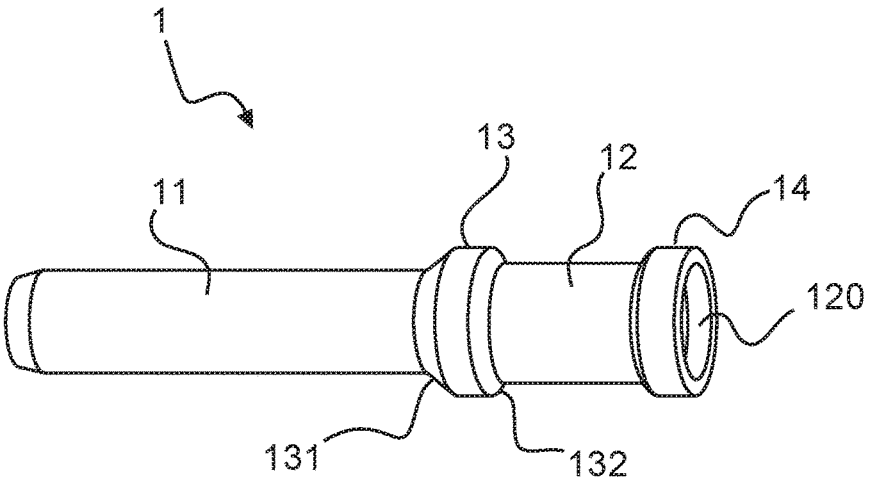
FIG. 1 shows a plug contact.

FIG. 1 shows a plug contact 1 known from the prior art. In the present example, it is realized as a pin contact since its mating region is formed by a contact pin 11. In a further embodiment, a socket contact can be similarly used, which only differs therefrom in that its mating region is designed as a contact socket.

The plug contact 1 has a cable connection region, which is realized as a crimp connection 12. Therefore, in technical language, the plug contact 1 is also known as a "crimp contact". The crimp connection 12 is realized in the form of a sleeve, namely hollow-cylindrically, and therefore features a cylindrical crimp opening 120 and has a connection-side collar 14 at its free end.

In diverse contact carriers provided for this purpose in the prior art, which are referred to below as "conventional" contact carriers, this plug contact 1 could be held at its connection-side collar 14 for the purpose of absorbing mating forces acting in the connection direction. However, as a result of the elongation of its crimp connection 12, which varies depending on the crimping process, structural disadvantages then arise, which will be described in more detail below.

A central collar 13 is arranged between the mating region 11 and the crimp connection 12. On the one hand, the central collar 13 has the function, together with the connection-side collar 14, of ensuring the guidance of the plug contact 1 within the respective contact carrier and thereby centering the contact pin 11, for example in a hollow-cylindrical through-opening of the contact carrier. On the other hand, the central collar 13 has a mating-side holding face 131. This can prevent that the plug contact 1, during its insertion, penetrates too deeply into the respective contact carrier in the direction of a mating side thereof, for example during the insertion of the plug contact 1 or as a result of pulling forces.

If the elongation experienced by the crimp connection 12 during the crimping is somewhat shorter than expected, the plug contact 1 in the conventional contact carrier has correspondingly large play in the mating direction. If the elongation is somewhat greater than expected, this can lead to difficulties when assembling the plug contacts 1 on the conventional contact carrier, namely if the crimped crimp connection 12 no longer fits in that portion of the conventional contact carrier which is provided to receive it.

To enable/facilitate the removal of the plug contact 1 from the conventional contact carrier, the central collar 13 furthermore has a connection-side chamfer 132. For manufacturing reasons, in the present embodiment, the mating-side holding face 131 is also chamfered, although this is not important with regard to the following considerations. The connection-side collar 14, on the other hand, does not require a connection-side chamfer since it is arranged in any case on a connection side of the conventional contact carrier and therefore does not offer any notable resistance to its removal by canting or the like.

For the reasons mentioned above, the inventive contact carrier K, which will be presented below, is intended to hold the plug contact 1 at its central collar 13 on both sides; on the one hand, to thereby avoid the problem, described above, of imprecise elongation of the crimp connection 12 and, on the other, to ensure particularly precise and stable guidance of the plug contact 1.

Figure 2A:
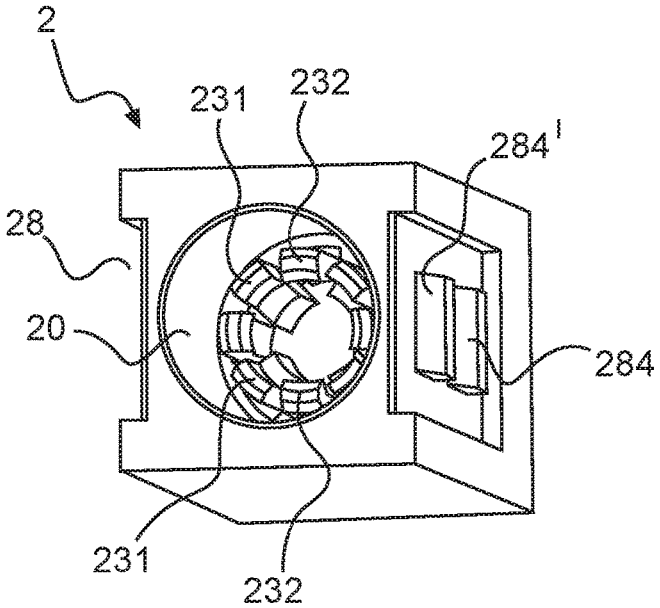
FIG. 2*a* shows an insulating body.
Figure 2B:
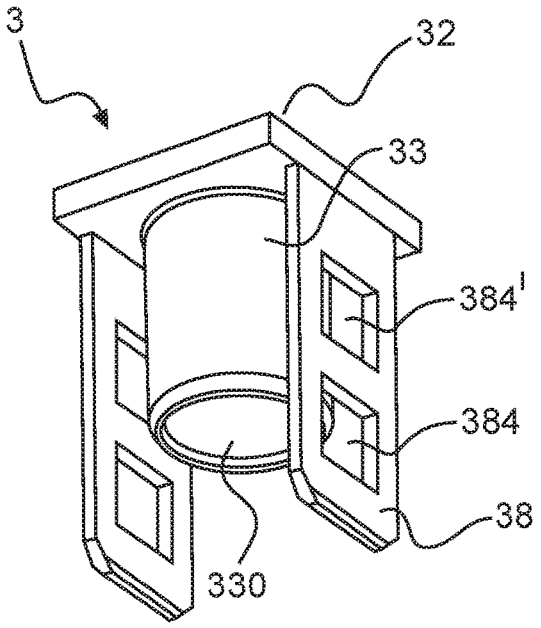
FIG. 2*b* shows a holding plate.

To this end, an arrangement is used which comprises an insulating body 2 shown in FIG. 2*a* and a holding plate 3 shown in FIG. 2*b*.

The insulating body shown in FIG. 2*a* is designed to be substantially square. It has a centrally arranged cylindrical through-opening 20 and two depressions 28, which are rectangular in cross-section and, starting on the connection side and extending in the mating direction, are realized on two mutually opposite sides of the insulating body 2. Each of the two depressions 28 is delimited by two lateral webs, which, for the sake of clarity, are not denoted by reference signs. Two integrally formed latching portions 284, 284', namely a first integrally formed latching portion 284 and a second integrally formed latching portion 284', are arranged in these two depressions 28, offset from one another in the mating direction. These each have a slide-on chamfer and a latching arm, which, for the sake of clarity, are not denoted by a reference sign.

In the through-opening 20, four holding elements 231 and four latching elements 232 are integrally formed in an alternating sequence on a circumferential inner collar 23. The latching elements are latching arms 232, which project into the through-opening 20 to latch on the central collar 13 of the plug contact 1 by means of latching lugs 2322 integrally formed on said latching arms.

The holding elements 231 each have a holding portion 2311 in order to thereby hold the plug contact 1 at its mating-side holding face 131 of its central collar 13 and therefore prevent a deeper movement of the plug contact 1 in the direction of a mating side S of the contact carrier K.

For the sake of clarity, the circumferential inner collar 23 and the holding portion 2311 and the latching lugs 2322 are not denoted by a reference sign in this illustration. They are, however, also clearly shown in terms of their respective function in FIG. 5*a* and FIG. 5*b* and are identified accordingly.

FIG. 2*b* shows a holding plate 3. This has a rectangular base plate 32 with an insertion opening 330, which extends through a hollow-cylindrical locking sleeve 33 integrally formed on the base plate 32.

A respective fastening plate 38 is integrally formed on two mutually opposite sides of the base plate 32, at a right-angle thereto. For multi-stage latching, two respective latching windows 384, namely a first latching window 384 and a second latching window 384', are arranged on each fastening plate 38. To construct the contact carrier K, the fastening plates 38 can be inserted into the depressions 28 of the insulating body 2, in particular fitting precisely between the lateral webs, whereby the latching windows 384, 384' latch on the integrally formed latching portions 284, 284'. At the same time, the locking sleeve 33 can be inserted into the through-opening 20.

Figure 3:
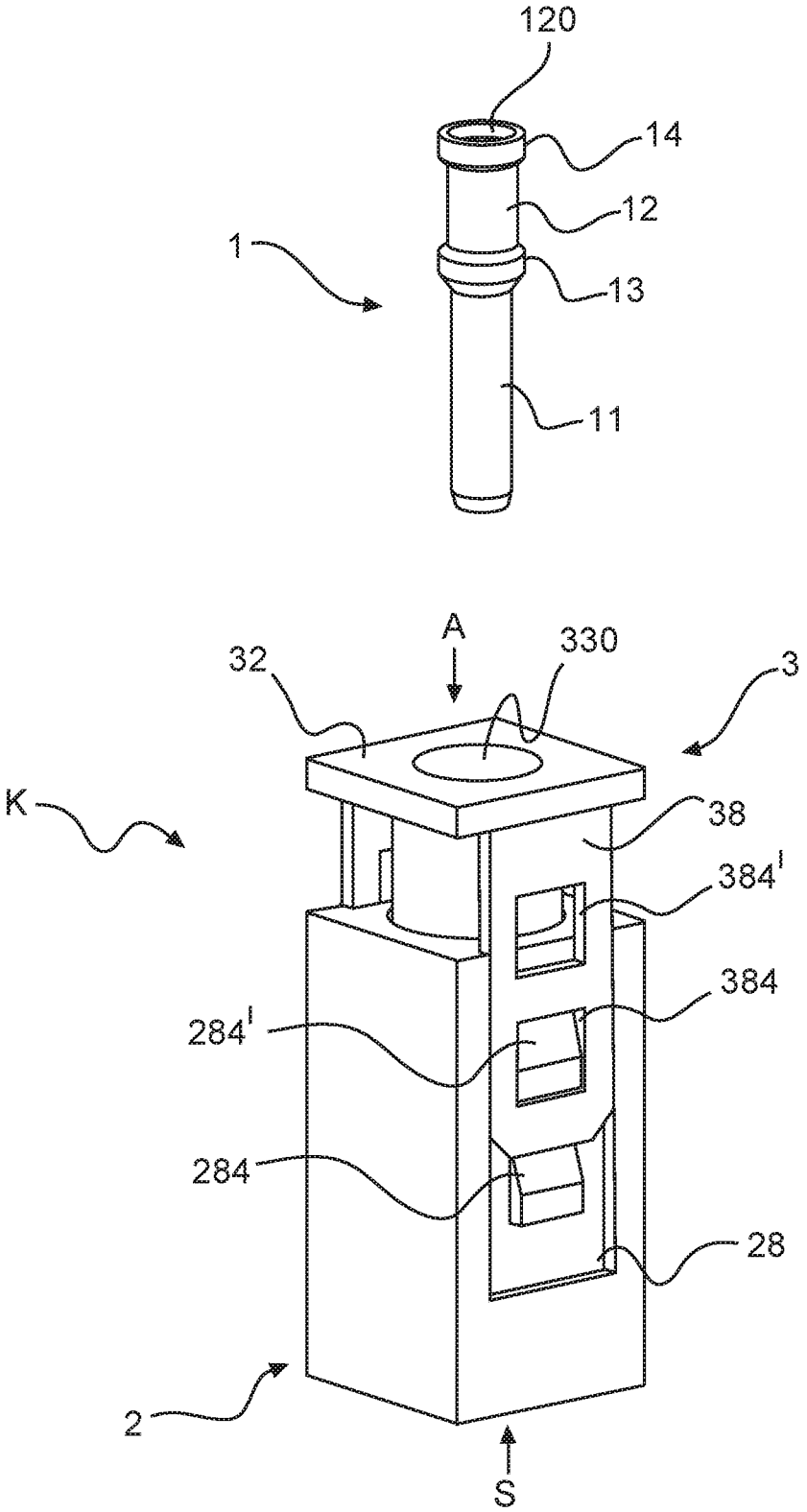
FIG. 3 shows a contact carrier, featuring the insulating body and the holding plate latched in an assembly position thereon, together with the plug contact to be inserted therein.

FIG. 3 shows the contact carrier K, which features the insulating body 2 and the holding plate 3 latched thereon in an assembly position, whereby the contact carrier is located in an assembly state. In this assembly state of the contact carrier K, the plug contact 1 can be inserted into the contact carrier K from the connection side A. Conventionally, the pin contact 1 is previously crimped to an electrical stranded conductor (not illustrated in the drawing) at its crimp connection 12.

In the assembly state, the first latching windows 384 of the holding plate 3 latch on the two integrally formed latching portions 284' of the insulating body 2. In this state, the locking sleeve 33 is only partially inserted into the through-opening 20 and, in this position, does not yet lock the latching arms 223 thereof against a movement into their release position. In this state, the plug contact 1 can be inserted into the contact carrier K from the direction of the connection side A.

Figure 4A:
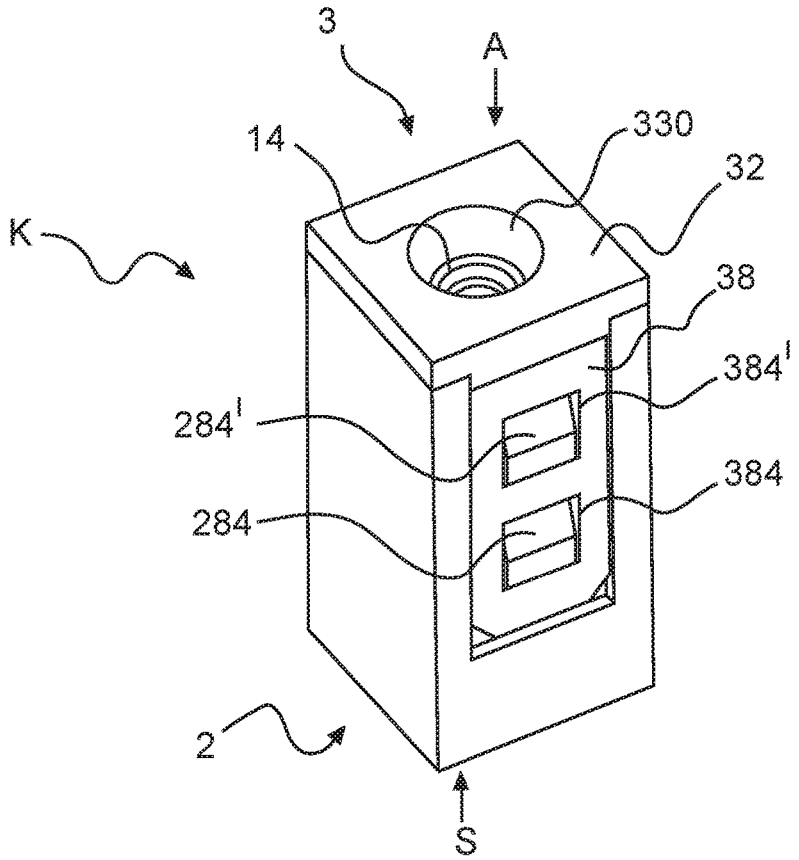
FIGS. 4*a-c* show the assembled, mounted contact carrier from different external views.

The connection side A and the mating side S are opposite one another. The contact carrier K has a mating side S on the opposite side. As a result of a further movement of the holding plate 3 in the mating direction, i.e. in the direction of this mating side S, the first latching window 384 latches on the first integrally formed latching portion 284 and the second latching window 384' latches on the second integrally formed latching portion 284', as illustrated in FIG. 4*a*. The holding plate 3 is therefore located in its locking position. The contact carrier K, together with the inserted plug contact 1, is then located in its mounted state, wherein only the connection-side collar 14 of the plug contact 1 can be seen in this illustration.

Figure 4B:
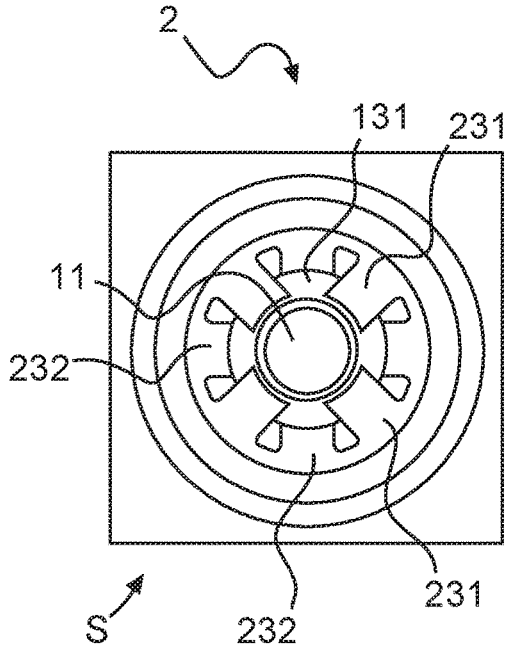

FIG. 4*b* shows the mounted carrier K as viewed from the mating side S.

Figure 4C:
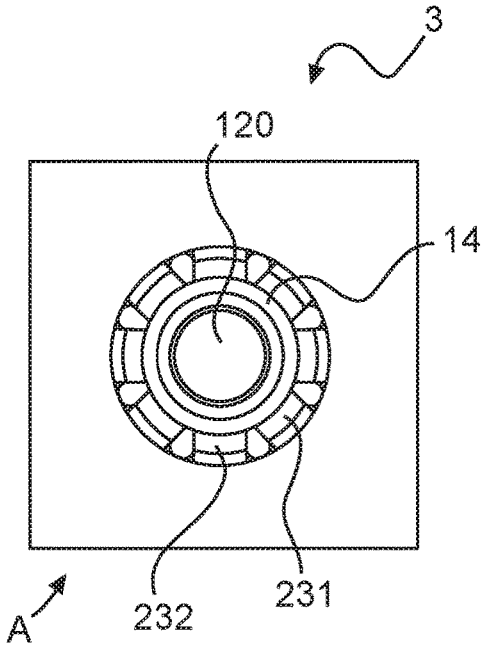

FIG. 4*c* shows the mounted contact carrier K as viewed from the connection side A.

Figure 5A:
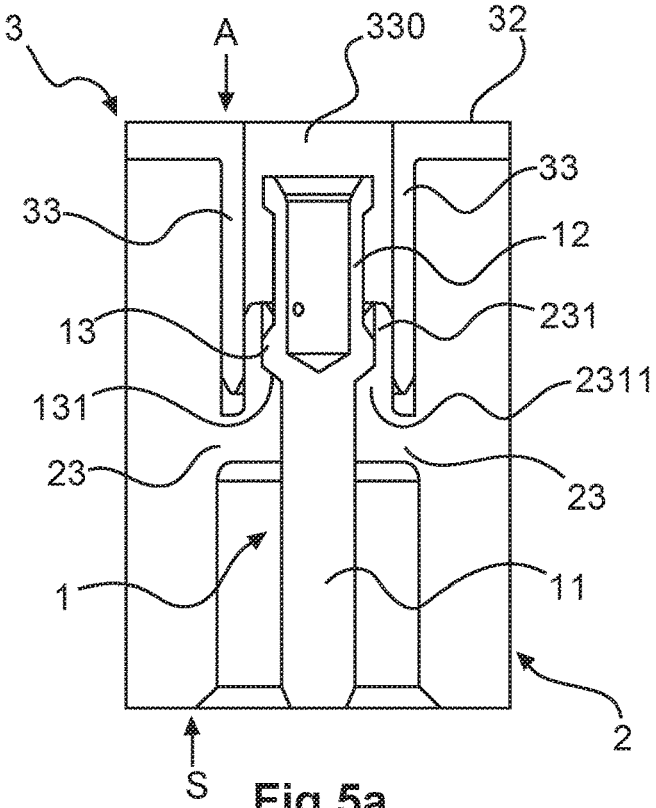
FIGS. 5*a, b* show the assembled, mounted contact carrier in two different external views.
Figure 5B:
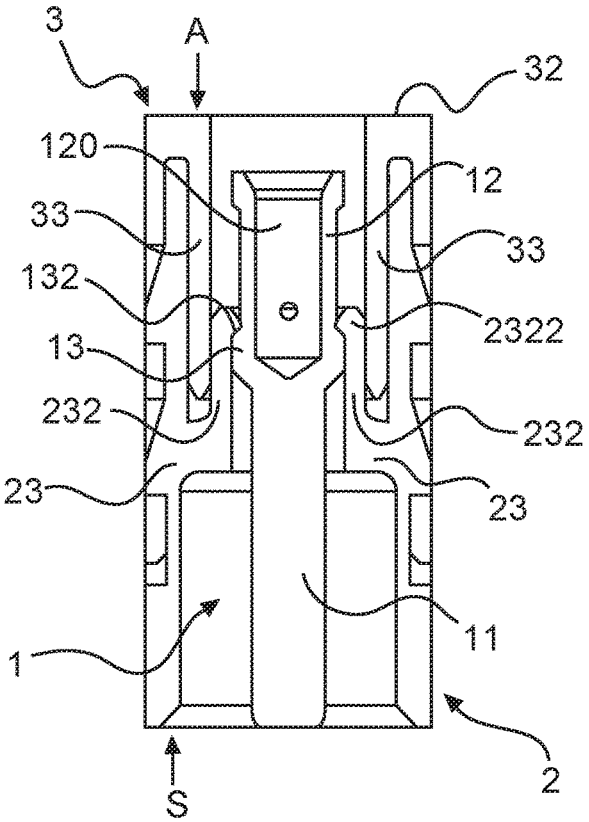

FIGS. 5*a* and 5*b* show the mounted contact carrier K in a cross-section through the holding elements 231 and through the latching arms 232.

It can be seen from FIG. 5*a* that the plug contact 1, by means of the holding face 131 of its central collar 13, is secured on the holding portion 2311 of the holding elements 231 against deeper insertion in the direction of the mating side S. It can furthermore clearly be seen that the holding elements are integrally formed on the circumferential inner collar 23 of the insulating body 2.

It can be seen from FIG. 5*b* how the latching arms 232, by means of their latching lugs 2322, fasten the plug contact 1 at the connection-side chamfer 132 of its central collar 13 against a movement in the direction of the connection side A in their locking state.

In this case, the locking sleeve 33 is arranged with force fit between the latching arm 232 and an inner surface of the through-opening 20 of the insulating body 2. The locking sleeve 33 thus prevents an outward movement of the latching arms 232, i.e. towards the said inner surface of the through-opening 200, and thereby prevents the transfer of the latching arms 232 from the position latching the plug contact 1 in place into the position releasing it.

Without the locking sleeve 33, the plug contact 1, by means of its connection-side chamfer 132, could easily press the latching arms 232 apart under the effect of mating forces which press it in the direction of the connection side A.

As a result of the locking sleeve 33, which is fully inserted into the insulating body 2, the plug contact 1 is fixed in its final mounted position in the contact carrier 2 with the desired high holding force. For this purpose, the locking sleeve 33 is arranged between the latching arms 232 and the inner surface of the insulating body 2 (i.e. its through-opening 20). The locking sleeve 33 thus prevents an outwardly directed movement of the latching arms 232, i.e. towards the inner surface of the insulating body 2. The latching arms 232 are therefore locked against being transferred into their release position. The plug contact, in spite of the connection-side chamfer 132 of its central collar 13, cannot press the latching arms 232 apart, even under the effect of high mating forces. It is therefore held in the contact carrier K in a particularly stable manner. The high mating forces are absorbed as necessary by the insulating body 2 on which the latching arms 232 are ultimately integrally formed on the inner surface. The holding plate 3 is therefore also not subjected to forces which unlock/dismantle it.

Even where combinations of different aspects or features of the invention are shown in the figures in each case, it is clear to the person skilled in the art—unless indicated otherwise—that the combinations shown and discussed are not the only possible combinations. In particular, mutually corresponding units or feature complexes from different exemplary embodiments can be interchanged with one another.

LIST OF REFERENCE SIGNS

1 Plug contact
11 Mating region, contact pin
12 Cable connection region, crimp connection
120 Crimp opening
13 Central collar
131 Mating-side holding face
132 Connection-side chamfer
14 Connection-side collar
2 Insulating body
20 Through-opening
23 Circumferential inner collar
231 Holding element
2311 Holding portion
232 Latching element, latching arm
2322 Latching lug
28 Depression
284, 284' First, second integrally formed latching portion
3 Holding plate
32 Base plate
33 Locking element, locking sleeve
330 Insertion opening
38 Fastening plate
384, 384' First, second latching window
K Contact carrier
A Connection side
S Mating side

The invention claimed is:

1. A contact carrier (K), suitable for receiving and fastening a plug contact (1), which has a crimp connection (12) and a central collar (13) having a connection-side chamfer (132), wherein the contact carrier (K) has a mating side (S) and, opposite thereof, a connection side (A), and wherein the contact carrier (K) includes an insulating body (2), a holding plate (3) configured to be mounted on the insulating body (2) on the connection side, and a latching element (232), which, in an unmounted state, can assume both a position latching the plug contact (1) in place and a position releasing the plug contact (1), wherein the latching element (232) is a component of the insulating body (2), and wherein the holding plate (3) has at least one locking element (33), which, in a mounted state, fixes the latching element (232) in the position latching the plug contact (1) in place and prevents the latching element (232) from transferring to the position releasing the plug contact, wherein the at least one locking element is a locking sleeve (33), which, in the mounted state, is arranged with force fit between the at least one latching element (232) and an inner surface of a through-opening (20) of the insulating body (2).

2. The contact carrier (K) as claimed in claim 1, wherein the at least one latching element is a latching arm (232) in each case, which is integrally formed on the inner surface of a circumferential inner collar (23) of the through-opening (20) of the insulating body (2).

3. The contact carrier as claimed in claim 2, wherein the insulating body (2) includes at least two latching arms (232) for latching the plug contact (1) against a movement of the plug contact (1) in the direction of the connection side (A) of the contact carrier (K).

4. The contact carrier (K) as claimed in claim 3, wherein the latching arm (232) has a latching lug (2322) with which it projects into an interior of the through-opening (20) and which serves to latch the plug contact (1) in place at its central collar (13).

5. The contact carrier (K) as claimed in claim 3, wherein the contact carrier (K) furthermore has at least two holding elements (231), which are integrally formed on the circumferential inner collar (23) of the through-opening (20) of the insulating body (2), wherein the at least two holding elements (231) each have a holding portion (2311) with which they project into an interior of the through-opening (20) in order to prevent a deeper movement of the plug contact (1) in the direction of the mating side (S) of the contact carrier (K).

6. The contact carrier (K) as claimed in claim 1, wherein the holding plate (3) can be latched on the insulating body (2) in two different positions, namely in an assembly position and a locking position, wherein, in the assembly position, the plug contact (1) can be inserted and latched in the contact carrier (K) on the connection side (A), and wherein the locking position corresponds to the mounted state in which the latching element (232), by means of the locking element (33), is fixed in its position latching the plug contact (1) in place and the plug contact (1) is thus finally held in the contact carrier (K) in a stable manner.

7. A method for mounting a plug contact (1) in a contact carrier (K), comprising:

providing the contact carrier (K) as claimed in claim 6;

latching the holding plate (3) on the insulating body (2) in its assembly position;

inserting the plug contact (1) into the insulating body (2), which plug contact is crimped to an electrical stranded conductor on the connection side;

detachably latching the plug contact (1) on the at least one latching element (232) by means of its chamfered central collar (13);

moving the holding plate (3) from its assembly position into its final locking position;

fixing the at least one latching element (232) in its latching position by means of the locking element (33) of the holding plate (3); and holding the plug contact (1) in the contact carrier (K) in a particularly stable manner and, by means of the insulating body (2), absorbing high mating forces acting on the plug contact (1).

8. A contact carrier (K), suitable for receiving and fastening a plug contact (1), which has a crimp connection (12) and a central collar (13) having a connection-side chamfer (132), wherein the contact carrier (K) has a mating side (S) and, opposite thereof, a connection side (A), and wherein the contact carrier (K) includes an insulating body (2), a holding plate (3) configured to be mounted on the insulating body (2) on the connection side, and a latching element (232), which, in an unmounted state, can assume both a position latching the plug contact (1) in place and a position releasing the plug contact (1), wherein the latching element (232) is a component of the insulating body (2), and wherein the holding plate (3) has at least one locking element (33), which, in a mounted state, fixes the latching element (232) in the position latching the plug contact (1) in place and prevents the latching element (232) from transferring to the position releasing the plug contact, wherein the holding plate (3) can be latched on the insulating body (2) in two different positions, namely in an assembly position and a locking position, wherein, in the assembly position, the plug contact (1) can be inserted and latched in the contact carrier (K) on the connection side (A), wherein the locking position corresponds to the mounted state in which the latching element (232), by means of the locking element (33), is fixed in its position latching the plug contact (1) in place and the plug contact (1) is thus finally held in the contact carrier (K) in a stable manner, wherein the holding plate (3) has at least one fastening plate (38) having two latching windows (384, 384'), namely a first latching window (384) and a second latching window (384'), and wherein the insulating body (2) includes at least two integrally formed latching portions (284, 284') corresponding thereto on an outer surface, namely at least one first integrally formed latching portion (284) and at least one second integrally formed latching portion (284'), and wherein the holding plate (3) is located in the assembly position when the at least one fastening plate (38) latches on the second integrally formed latching portion (284') by means of its first latching window (384), and wherein the holding plate (3) is located in its locking position when the first latching window (384) latches on the first integrally formed latching portion (284) and the second latching window (384') latches on the second integrally formed latching portion (284').

9. The contact carrier (K) as claimed in claim 8, wherein the holding plate (3) has a rectangular base plate (32) with an insertion opening (330) for inserting the plug contact (1), and wherein a respective fastening plate (38) extending at a right angle to the base plate (32) is arranged on two mutually opposite sides of the base plate (32), wherein these two fastening plates (38) point in the same direction as the at least one locking element (33).

* * * * *